US007058997B1

(12) United States Patent
Klinger

(10) Patent No.: US 7,058,997 B1
(45) Date of Patent: Jun. 13, 2006

(54) SLEEPING BAG ON ROLLERS WHICH CONVERTS INTO A BACKPACK

(76) Inventor: Sherry Klinger, 15426 Albright St., Pacific Palisades, CA (US) 90272

( * ) Notice: Subject to any disclaimer, the term of this patent is extended or adjusted under 35 U.S.C. 154(b) by 88 days.

(21) Appl. No.: 10/937,913

(22) Filed: Sep. 10, 2004

Related U.S. Application Data

(60) Provisional application No. 60/503,842, filed on Sep. 16, 2003.

(51) Int. Cl.
*A47G 9/08* (2006.01)
*A47G 9/06* (2006.01)

(52) U.S. Cl. ..... 5/413 R; 5/420; 190/18 A; 224/153; 383/4

(58) Field of Classification Search ..... 5/413 R, 5/413 AM, 482, 420, 636; 383/4; 224/153, 224/156; 190/2, 18 A
See application file for complete search history.

(56) References Cited

U.S. PATENT DOCUMENTS

| | | | | |
|---|---|---|---|---|
| 33,385 | A | 10/1861 | Frodsham | |
| 730,877 | A | 6/1903 | Clapham | |
| 1,102,200 | A | 6/1914 | Miller | |
| 2,133,717 | A | 10/1938 | Robes | |
| 3,178,734 | A | 4/1965 | Carrez | |
| 3,483,575 | A | 12/1969 | McCarthy | |
| 4,774,734 | A | 10/1988 | Mills | |
| 5,346,308 | A | 9/1994 | Buhot et al. | |
| 5,618,110 | A | 4/1997 | Sullivan | |
| 5,644,806 | A * | 7/1997 | Mariol et al. | 5/99.1 |
| 5,730,529 | A | 3/1998 | Fritz | |
| 5,785,219 | A | 7/1998 | Kraft | |
| D401,736 | S | 12/1998 | Shaw | |
| 6,061,831 | A | 5/2000 | Rudolph | |
| 6,105,188 | A | 8/2000 | Perez-Mesa et al. | |
| 6,186,380 | B1 | 2/2001 | Grounds | |
| 6,463,604 | B1 * | 10/2002 | Reveron et al. | 5/413 R |
| 6,493,891 | B1 * | 12/2002 | Livingston | 5/636 |
| 6,543,072 | B1 * | 4/2003 | Hsu | 5/413 R |

FOREIGN PATENT DOCUMENTS

| | | |
|---|---|---|
| WO | WO 93/04610 | 3/1993 |
| WO | WO 99/60884 | 12/1999 |

* cited by examiner

*Primary Examiner*—Alexander Grosz
(74) *Attorney, Agent, or Firm*—Thomas I. Rozsa; Tony D. Chen

(57) ABSTRACT

The present invention is a new, original and novel one piece sleeping bag/backpack with rollers that is folded and contained in an attached pocket cavity enclosure, and when folded becomes a square pillow. In addition, there is an optional matching small pillow that fits inside one of the many pockets contained on the sleeping bag for the child to use for his/her head when laying in the sleeping bag. The rollers/wheels are small and can be made with the rollers sewn and permanently attached to the bottom of the sleeping bag. The rollers are also conveniently attached with the use of snaps or Velcro® so that they can be removed for the washing machine. However, that is not necessary because the wheels are so small it causes no problem in the washing machine if they were permanently attached. If the wheels are attached it causes no discomfort to the child as they are positioned in such a way that the child does not notice them while sleeping or resting. However, in the removable ones, the child will have the option to remove them if he/she chooses. The invention uses both because in some cases the smaller younger children stand the possibility of losing or misplacing the wheels if they are removed while they are sleeping, whereas the parent may like the idea of removing them for the wash.

9 Claims, 3 Drawing Sheets

SLEEPING BAG ON ROLLERS WHICH CONVERTS INTO A BACKPACK

This application claims the benefit of U.S. Provisional Patent Application Ser. No. 60/503,842 filed on Sep. 16, 2003, the contents of which are incorporated by reference herein.

BACKGROUND OF THE INVENTION

1. Field of the Invention

The present invention generally relates to a sleeping bag on rollers which converts into a backpack. The device also relates to a fabric holding device which converts into a towel and a backpack and holder which also converts into a comforter.

2. Description of the Prior Art

In general, sleeping bags and backpacks are well known in the art; however they all have certain problems which are addressed by the present invention.

Historically, from the time a child is out of the crib and into his or her own bed, the sleeping bag comes in handy. From the ages of 5 to 11, children enjoy "sleepovers", either having their friends over to spend the night or going to a friend's to spend the night at their house. However, beds are limited in the respective homes and almost in every case, the guest requires a sleeping bag. Most sleeping bags for children are cumbersome, heavy, difficult to roll up and put back into its separate round holder and it becomes a mess which only the parents can fix. In addition, these traditional sleeping bags usually are made out of the outdoor fabric and can be too hot for sleeping inside the house of their friend. Traditional sleeping bags also do not traditionally have additional pockets or compartments in which to hold items such as pajamas, toys, toothbrushes and the like, so the child would also have to carry a bag or suitcase. Since traditional sleeping bags for children do not have straps or wheels to convert a carrying sleeping bag into a backpack style sleeping bag to carry either on the back or shoulder, or to be used as a pulley on wheels to roll, both of the child's hands will be full trying to carry their bag or suitcase as well as the sleeping bag. As a result, the bags are too heavy and cumbersome for the child to carry and the parent usually has to help carry the bags and accessory items to the place of the sleepover. Therefore, there is a need for a sleeping bag on rollers which converts to a backpack.

In addition, when the sleeping bag is returned home, it is usually a mess and not folded back properly because it is too difficult for the child to roll it up tight enough. The parents then have to carry it into the car and then into the home—otherwise the child will usually just drag it on the floor/ground and it will rip. Some sleeping bags for children have no carrying case at all and the children drag the entire bag along the floor. When it is time to wash the sleeping bag since they are usually made out of outdoor type fabric, they are difficult to put in the washing machine and can, in fact, cause damage to the washing machine. As far as storage is concerned, it is cumbersome and bulky and usually takes up an enormous amount of space on the closet shelf.

The following prior art references are found to be relevant.

1. U.S. Pat. No. 33,385 issued to Frodsham & Levett on Oct. 1, 1861 for "Accouterments" (hereafter the "Frodsham & Levett Patent")

2. U.S. Pat. No. 730,877 issued to Clapham on Jun. 16, 1903 for "Combined Blanket Roll, Field Mattress, and Clothing Bag" (hereafter the "Clapham Patent");

3. U.S. Pat. No. 1,102,200 issued to Miller on Jun. 30, 1914 for "Camp Pack" (hereafter the "Miller Patent");

4. U.S. Pat. No. 2,133,717 issued to Robes on Oct. 18, 1938 for "Sleeping Pack" (hereafter the "Robes Patent");

5. U.S. Pat. No. 3,178,734 issued to Carrez on Apr. 20, 1965 for "Bedding Article" (hereafter the "Carrez Patent");

6. U.S. Pat. No. 3,483,575 issued to McCarthy on Dec. 16, 1969 for "Multipurpose Fabric" (hereafter the "McCarthy Patent");

7. U.S. Pat. No. 4,774,734 issued to Mills on Oct. 4, 1988 for "Convertible Sleeping Bag And Stuffed Toy" (hereafter the "Mills Patent");

8. U.S. Pat. No. 5,436,308 issued to Buhot on Sep. 13, 1994 for "Bag With Storage Pocket Which Converts Into A Beach Towel" (hereafter the "Buhot Patent");

9. U.S. Pat. No. 5,618,110 issued to Sullivan on Apr. 8, 1997 for "Combination Beach Towel And Tote Bag With Backpack" (hereafter the "Sullivan Patent");

10. U.S. Pat. No. 5,730,529 issued to Fritz on Mar. 24, 1998 for "Combination Beach Mat And Carrying Device" (hereafter the "Fritz Patent");

11. U.S. Pat. No. 5,785,219 issued to Kraft on Jul. 28, 1998 for "Combination Knapsack" (hereafter the "Kraft Patent");

12. U.S. Pat. No. Des. 401,736 issued to Shaw on Dec. 1, 1998 for "Bed Roll For Children" (hereafter the "Shaw Patent");

13. U.S. Pat. No. 6,061,831 issued to Rudolph on May 16, 2000 for "Coat-Sleeping Bag/Backpack Combination Garment And Camping equipment Named "Coatbag" " (hereafter the "Rudolph Patent");

14. U.S. Pat. No. 6,105,188 issued to Perez-Mesa on Aug. 22, 2000 for "Nap-Sac Carrying Pouch And Child Sleeping System" (hereafter the "Perez-Mesa Patent");

15. U.S. Pat. No. U.S. Pat. No. 6,186,380 B1 issued to Grounds on Feb. 12, 2001 for "Combination Sleeping Pad And Backpack" (hereafter the "Grounds Patent");

16. PCT Application No. WO 93/04610 (hereafter the "Girardet PCT Application").

17. PCT Application No. WO 99/60884 (hereafter the "Steenblock PCT Application").

The Frodsham & Levett Patent is a combination knapsack and bed but in this case, the knapsack and bed are sewn together and retained by members by which it can be carried on the back.

The Clapham Patent discloses a combined blanket roll, field mattress and clothing bag. In this case, the blanket roll is designed to be rolled up around a blanket so that when it is rolled, it may be doubled and slung over the shoulder.

The Miller Patent discloses a blanket or covering which may be used as a pack sack and may be combined with a sleeping mattress to form a close sleeping envelope over a person. It also carries shoulder straps by which the folded blanket can be carried.

The Robes Patent discloses a sleeping bag which can be folded on itself and tied together so that the contents can be retained within the bag and to which there is also attached a member by which a structure can be attached to the back of the bag through which straps can be attached so that the straps can be used to carry the sleeping bag on a person's back.

The Carrez Patent discloses a bedding article that can be used as a sleeping bag, where the bag is formed from two sheets assembled together, as well as a quilted member which is provided for warmth.

The McCarthy Patent discloses a multipurpose fabric which can be used as a sleeping bag, raincoat, hammock etc.

and which has straps thereon so that when folded together, it can be carried as a backpack.

The Mills Patent discloses the concept of having a backpack with one edge or sewn onto the carrying case so that the carrying case can be folded inside out for the backpack to function as a sleeping bag or other sleeping article and then when it is reversed and turned inside out, it can be carried as a backpack or alternatively, can simply function as a toy.

The Buhot Patent discloses a bag with a storage pocket which converts into a beach towel.

The Sullivan Patent is a combination beach towel and tote bag with backpack. In this case, however, the bag is sewn to the upper corner of the towel along one face and can fold inside out and is closed by rope fasteners which extend through a folded over channel in the bag.

The Fritz Patent is a combination beach mat and carrying device. This device rolls up into a duffel bag type structure.

The Kraft Patent discloses a combination knapsack including a mat permanently attached to one of the walls of a main storage compartment and a flap permanently attached to another of the walls of the main storage compartment.

The Shaw Patent discloses a bed roll for children.

The Rudolph Patent discloses a sleeping bag and backpack combination designed to carry accessories that may be needed by a user. It is a coat bag which is a convertible, combination garment/equipment for camping and recreational use during winter activities. The coat bag transforms from a coat and backpack into a sleeping bag. The resulting one-piece unit is also designed to accommodate accessories.

The Perez-Mesa Patent discloses the concept of having a carrying pouch which can retain a sleeping blanket which can be folded therein and which sleeping blanket is attached along three edges. The concept is to have the pouch carrying the entire sleeping blanket and then when in use, the pouch is laid on the ground and the sleeping blanking is unfolded from the pouch.

The Grounds Patent is a combination sleeping pad and backpack.

The Girardet PCT Application is for a backpack convertible into a camp bed. The backpack includes a non-rigid compartment surrounded by another non-rigid removable compartment. The compartment is fixed by means of straps to a transformable frame.

The Steenblock PCT Application discloses a towel which can be transformed into a beach bag.

SUMMARY OF THE INVENTION

The present invention is a new, original and novel one piece sleeping bag/backpack with rollers that is folded and contained in an attached pocket cavity enclosure, and when folded becomes a square pillow. In addition, there is an optional matching small pillow that fits inside one of the many pockets contained on the sleeping bag for the child to use for his/her head when laying in the sleeping bag. The rollers/wheels are small and can be made with the rollers sewn and permanently attached to the bottom of the sleeping bag. The rollers are also conveniently attached with the use of snaps or Velcro® so that they can be removed for the washing machine. However, that is not necessary because the wheels are so small it causes no problem in the washing machine if they were permanently attached. If the wheels are attached it causes no discomfort to the child as they are positioned in such a way that the child does not notice them while sleeping or resting. However, in the case of the removable ones, the child will have the option to remove them if he/she chooses. The invention uses both because in some cases the smaller younger children stand the possibility of losing or misplacing the wheels if they are removed while they are sleeping, whereas the parent may like the idea of removing them for the wash.

The sleeping bag also converts to a backpack so that the child no longer has to suffer carrying everything in his or her arms and dropping items or being uncomfortable due to the weight of the bag. The straps are attached with Velcro® and therefore are removable for washing, although the straps do not have to be removed. The straps go around the shoulders with the backpack on the child's back for comfort. The strap can also be used as a shoulder strap and thus would convert the bag into a shoulder bag.

One of the most novel features of the sleeping bag/backpack is that it is a sleeping bag on rollers/wheels. The child now has a choice to either carry the sleeping bag over his/her shoulder or back or simply roll it like a school backpack. The reason this feature is extremely important is because most children are required in school these days to bring heavy loads of books back and forth in backpacks. These backpacks are often very heavy and over time can cause back problems for the growing child. Many chiropractors these days are complaining about this issue and attribute the high rise and incidence of poor posture and childhood back problems to these backpacks. Since the heaviness of traditional sleeping bags could cause the same problems, the rollers on the present invention sleeping bag will avoid that problem when the overnight load becomes too heavy for a child to carry. It will also allow the child to have his/her arms free to carry additional items.

There are at least two additional pockets on the backpack in addition to the original pocket in which the entire sleeping bag is placed. The original one is the large pocket in which the actual sleeping bag that is folded belongs. A second "envelope" or "pocket" is sewn on top of the first one with its closure by Velcro®. This allows the child the ability to insert his/her pajamas, stuffed toy, toothbrush and any other items. There is a third pocket that is sewn over the second pocket which allows more room for more items such as a book, a computer game, a video, etc.

The fabric that is used is important in that it is 100% cotton with an inside batting, and therefore the child will not get overly heated while sleeping in it no matter what the weather in any state/city in any climate, any time of the year. With traditional sleeping bags, the child would be too hot because the bags are usually made out of outdoor fabric and fillings in order to be warm for outdoor camping. However, the fabric can be interchanged in the event the bag is to be converted to an outdoor bag and at that time could be made of outdoor fabric.

The fact that this sleeping bag is all attached with no external or separate cover makes it much easier for both the child and the parent. The child does not have to run the risk of losing the cover and it is also much easier for the child to fold up the sleeping bag into the attached pocket than to roll it tight enough in order to stuff it into a separate round container.

The present invention sleeping bag is also superior over traditional bags in that it can actually be stored in the closet on a hanger or rack rather than having to take up large amounts of space in a closet on a shelf or in the garage. Because of the attached straps, the bag can be hung over a hanger and fit right into the closet. It can also be stored on a shelf as traditional bags but would not be as cumbersome and bulky due to the fact that it is made of the lighter weight material.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
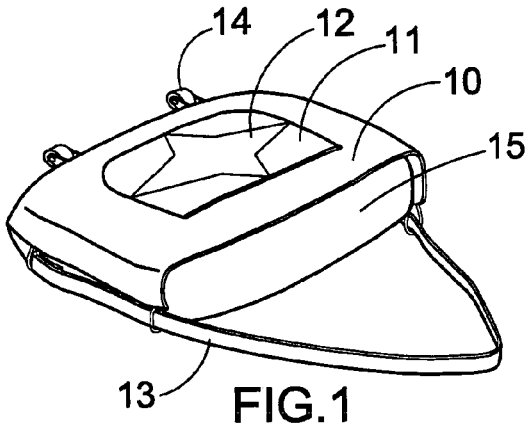
FIG. 1 is a perspective view of the present invention sleeping bag as it is folded into its final, ready to wear carrying and storage state.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The invention consists of a fabric container which has two sides which are sewn together along the lengthwise edges and along the bottom. Sewn into the interior of the fabric container adjacent the closed end is a bedspread which can be folded along its lengthwise edges and then rolled up or folded up into two or three sections and thereafter placed within the fabric container. The fabric container contains along its outside strap members and shoulder members so that the device can be worn as a backpack or alternatively, worn over one shoulder through a shoulder strap. When in use, the device is placed on the ground and the exterior covering is folded inside out to expose the sewn in bedspread which then can be unrolled and there is a side zipper which unzips the bedspread so an individual can sleep within the bedspread which forms a sleeping bag.

Also attached to a side of one of the two pieces of fabric which form the external cover is a pocket member which can be closed by Velcro® and which can contain toothbrushes and other items which a person can use for an overnight stay at a friend's house. There can also be several pockets sewn on both sides of the covers so that they can contain a multiplicity of different items to be used for overnight purposes. The pockets can be closed with snap fasteners, mating Velcro® fasteners or other types of closable members.

When open completely, the overall sleeping bag is 75 inches long by 30 inches wide. It is made long and wide enough to accommodate the growing needs of children and is intended for use by children from one year up to 12 years. The same design can be made for adults for traveling purposes by making it longer and wider. With this unique, one of a kind, revolutionary design, the sleeping bag actually folds into itself in a self-contained attached pocket and becomes its own carrying case pouch, with a detachable/attachable-carrying strap attached by Velcro® for easy removing. Not only can this bag be worn as a backpack or over the shoulder as a shoulder bag, but, in addition, it can be pulled by the strap, as for the first time ever in the history of sleeping bags, it has rollers that are attached to the bottom of the bag on the outside seam on the bottom when it is in its closed, ready-to-use position and thus, can be rolled by the user instead of carrying it over his/her shoulder or back. In some instances the rollers are also made to be removable. While the sleeping bag is in its closed position, it becomes a pillow that is 20 inches by 16 inches. It also contains two additional pockets that are on the outside of the bag while it is closed that are intended to be for carrying items that the child/adult would like to take on their overnight adventures. Both these pockets are large enough to accommodate a variety of personal belongings such as pajamas, toothbrushes, hairbrushes, towels, stuffed animals, books, computer software games and any other small items that the child/adult would like. They are secured by Velcro®. The top second pocket is designed in the shape of a specific animal or thing that matches the fabric. For example, if the print on the fabric were of stars, then the top pocket would be in the shape of a star, closed by the Velcro®. If it were a print that has dolphins on it, then the top pocket would be in the shape of a dolphin, etc. The sleeping bag can be made of a variety of fabrics, depending upon if the intended use is for indoor or outdoor use. In between the layers, there is batting material to keep the user warm and to make the bag soft for use on the floor.

Figure 7:
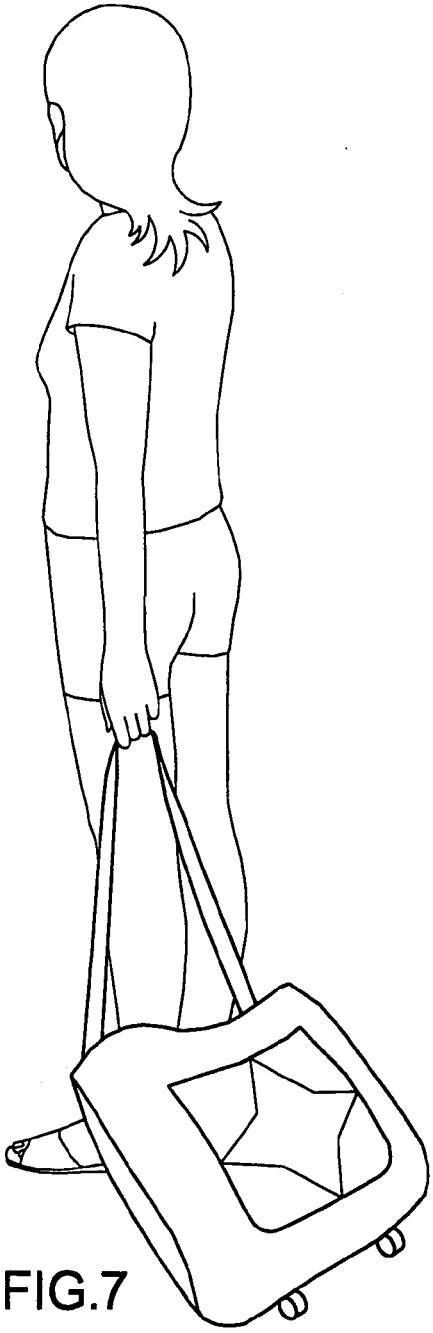
FIG. 7 is a perspective view showing the sleeping bag as it is rolled along the ground.
Figure 8:
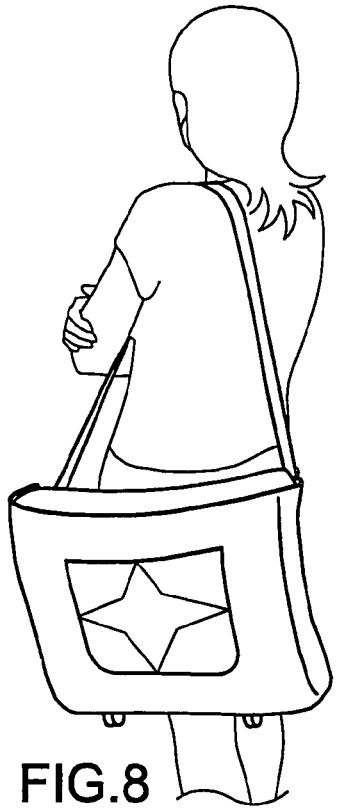
FIG. 8 is a perspective view showing the sleeping bag worn as a shoulder bag.
Figure 9:
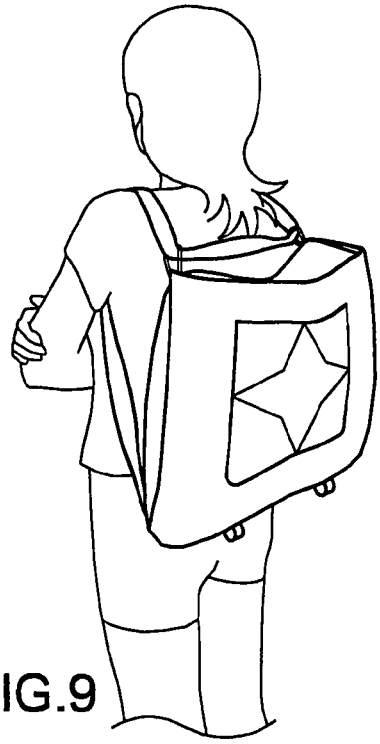
FIG. 9 is a perspective view showing the sleeping bag being used as a backpack.

FIG. 1 is a view of the sleeping bag as it is folded into its final, ready-to-wear carrying and storage state. In this state the sleeping bag becomes a pillow that a child can use on which to lay their head. It is soft and cushioned with the full sleeping bag stuffed into itself in a square shape. It also is ready to be used as either a backpack (see FIG. 9) or as a shoulder bag (see FIG. 8) or rolled as a pulley (see FIG. 7) with two attached storage pockets. No. 10 in FIG. 1 is the base fabric of the bag as it sits in its complete folded state with the pocket sides up. On this base is sewn the first of two pockets (No. 11) which is sealed shut with Velcro®. Resting/sewn onto this first additional pocket is a second additional pocket (No. 12) that is smaller than the first pocket and which is designed into a specific shape that matches the print of the fabric. For example, if the print of the fabric includes stars, the second, smaller pocket on the top would be cut into the design of a star. This pocket, like the first one—and no matter what shape—is flat but loose enough to be able to hold more overnight personal items, and is secured with Velcro®. In this same FIG. 1 the present invention has a long strap 13 that is secured by Velcro® and is removable (see No. 13). It can be adjusted to be used as a backpack, shoulder bag or pulley by attached rollers. This strap is 30 inches long on each side when pulled straight up to be one strap around the shoulder or for pulley purposes. In the case when the sleeping bag is to be used as a backpack, it is pulled so that each side of the strap in which the arms go equals 20 inches and there is 20 inches of the strap in-between each shoulder over the back. All together the length of the strap is 60 inches. No. 14 are two small wheels/rollers that are secured onto the sleeping bag on the bottom of the item in its ready-to-use position. These rollers allow the user to pull the bag in the event there are heavy items in it, or just for pure convenience if the user requires the use of his arms or shoulders for other purposes or to carry other items. No. 15 is the portion of the sleeping bag that shows on the top as it is folded into its own original self-contained storage pocket.

Figure 2:
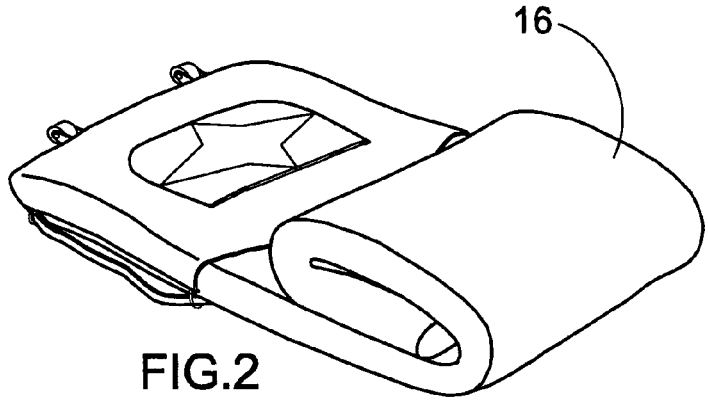
FIG. 2 is a perspective view of the present invention sleeping bag wherein a first step has been taken to remove the sleeping bag out of its self contained pocket.

FIG. 2 is from the perspective of taking the first step to removing the sleeping bag out of its self-contained pocket. No. 16 shows the bag as it is unfolding and how it appears after taking the first steps to removing it from its original pocket.

Figure 3:
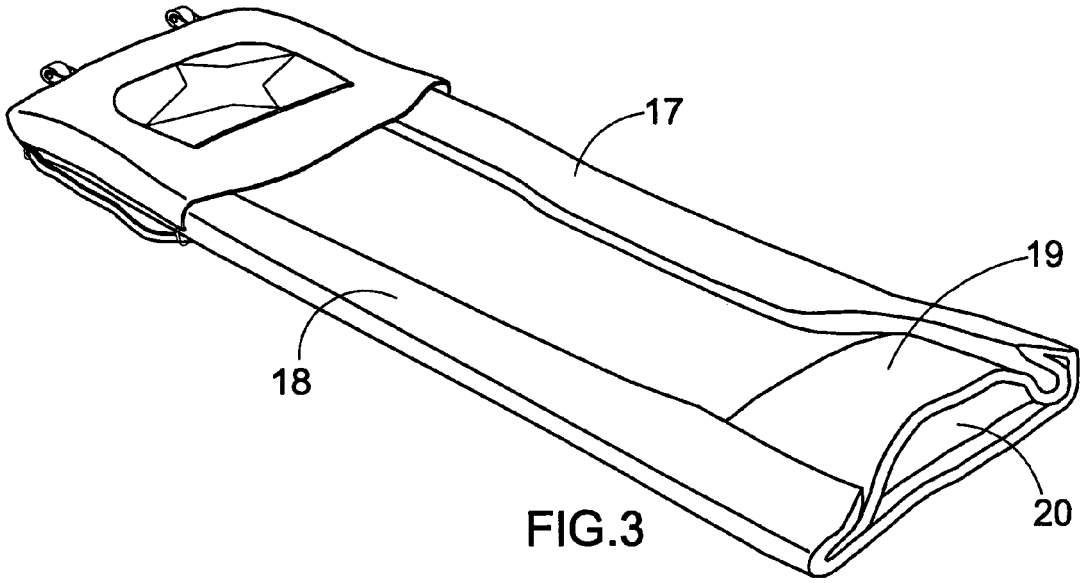
FIG. 3 is a perspective view of the present invention sleeping bag as it is removed lengthwise from the pocket, still leaving the sides folded into its widthwise condition.

FIG. 3 shows the sleeping bag as it is removed lengthwise from the pocket, still leaving the sides folded into its width-wide condition. It becomes flat, lying out in full length on the floor. In this figure the pockets are still face up, but are now in the metamorphosis state preparing to complete the process to unfold. All numbers 10, 11, 12, 13, and 14 remain in the same position as in FIG. 1. In FIG. 3 numbers 17 and 18 indicate the sides of the sleeping bag from the width perspective that are still enveloped into the pocket and maintained throughout the entire length of the unit. No. 19 indicates a budge at the top of the sleeping apparatus where the user's head would rest, as in No. 20, where there is shown an attached/removable small pillow on which user can rest his head. This pillow is attached by Velcro® and can be removed for washing and use by user's own discretion.

Figure 4:
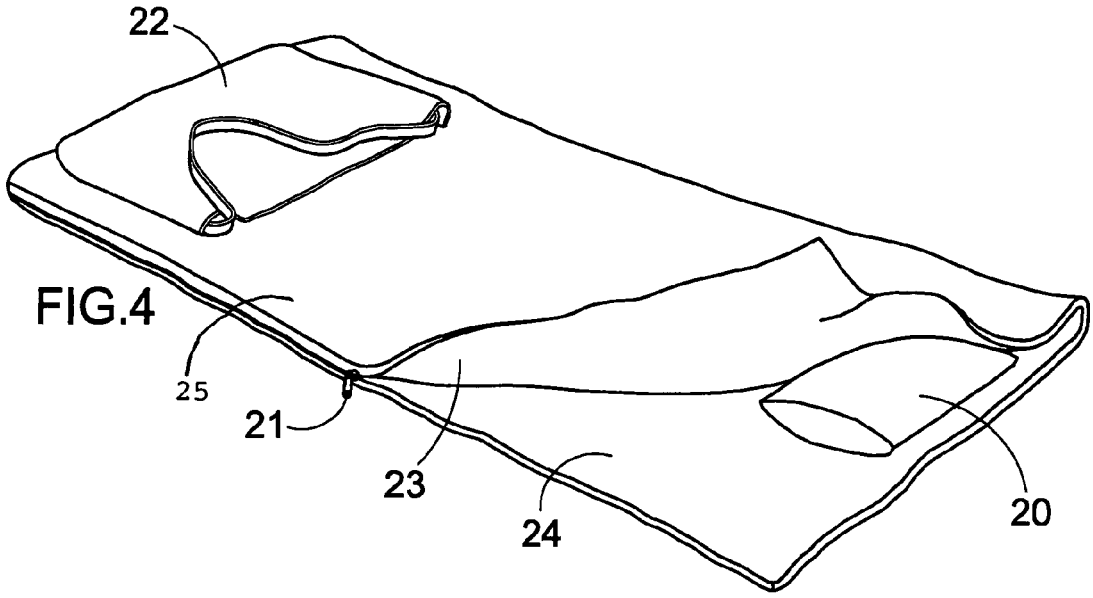
FIG. 4 is a perspective view of the present invention sleeping bag in its ready to use condition.

FIG. 4 illustrates the sleeping bag as it is ready to be used in its final state for sleeping. No. 20 shows the actual full sized pillow, which is attached by Velcro®. No. 21 is the zipper and in this figure it shows that the zipper has been opened half way down the bag. As in the case of a child's sleeping bag, it is 75 inches long and actually when completely zipped, it begins at the top of the bag where the head would rest. This allows the child/user to be able to get in and out of the bag by his/herself as it is in the most logical, convenient place—at the opening at the top. No. 22 shows that now the pocket is inside out and the second attached design pocket is actually inside, and the opposite side is now outside. As a result, the two small rollers are also inside at the bottom foot side of the sleeping bag. They are now contained in between the second pocket and the original pocket. A child has a choice to remove them if they are placed on in the removable fashion, or if they are attached permanently, they are in strategically placed locations whereby they do not interfere with the child and therefore, the child will not even notice that they are there. Item No. 23 is the inside top portion of the bag which is made of a warmer, softer and heavier fabric, as well as No. 24 which is the bottom inside portion of the bag which is also made of the same warmer, softer and heavier fabric as in No. 23. Inside/underneath No. 23 and No. 24 is a special batting fabric that adds to even more softness and warmth. However, it is not apparent in this illustration because you cannot see it in the bag as it is covered with the outside fabrics in No. 23 and No. 24. No. 25 displays the upper, top side (fabric) of the bag.

Figure 5:
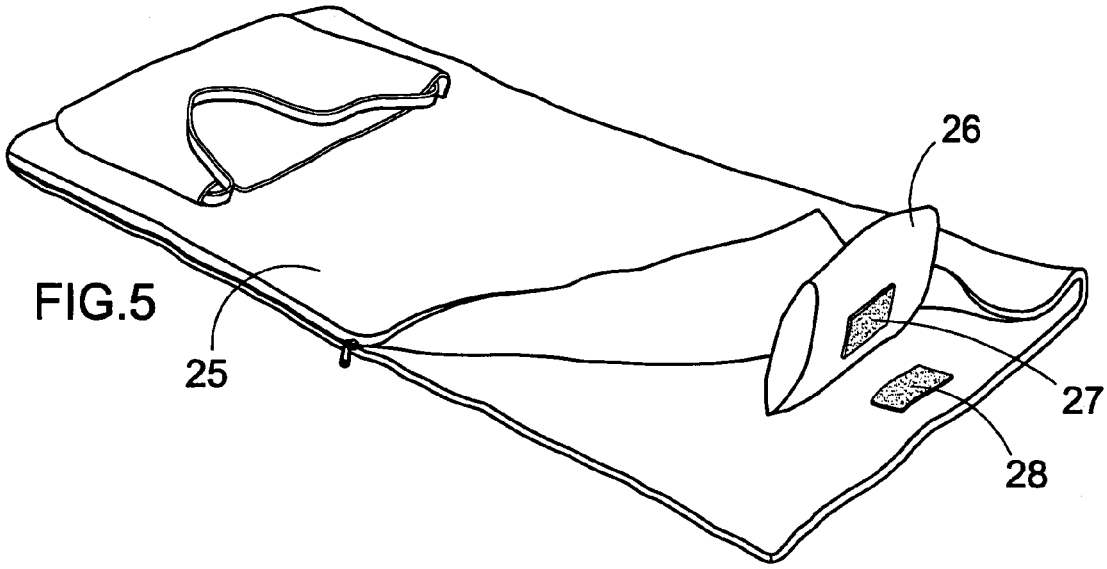
FIG. 5 is a perspective view of the present invention sleeping bag in its ready to use condition with the pillow moved upward to show Velcro® portions that attach the pillow to the sleeping bag.

In addition to what is shown in FIG. 4, FIG. 5 includes the backside of the pillow No. 26. No. 27 is the Velcro® that attaches the pillow to the other Velcro® as seen in No. 28. This attachment makes is easier for the pillow to be folded into the sleeping bag or the user may detach the pillow and contain it separately in one of its three pockets.

Figure 6:
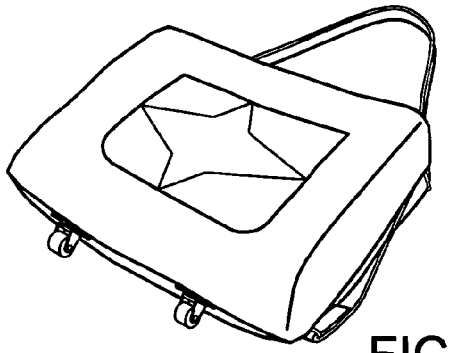
FIG. 6 is a perspective view of the entire sleeping bag folded into itself and ready for transport.

FIG. 6 shows the entire sleeping bag once again folded into itself complete with the wheels and carrying strap. This perspective shows the sleeping bag from the upright angle ready to be rolled instead of carried over the shoulder or as a backpack.

FIG. No. 7 shows the user actually rolling the sleeping bag and FIG. No. 8 shows the user carrying it as a shoulder bag. FIG. No. 9 shows the sleeping bag being used as a backpack sleeping bag.

NOT SHOWN IN THE FIGURES IS ALL THE STEPS OF THE PROCESS OF FOLDING THE BACKPACK INTO ITSELF AS DESCRIBED BELOW:

While the sleeping bag is laid completely open, turn it over so that the front (side with the pocket) is facing downward toward the floor.

Each side (No. 17 and No. 18, FIG. 3) now gets folded in toward the center. The folds/creases should each be at the very edge of the pockets and no more. Once they are in place, the bottom of the bag is folded up one time at approximately 15 inches. It is then folded one more time in an equal 15 inches. It is then folded over for the third and last time to complete the process so it is now in three equal folds. Now the entire bag is folded and ready to be inserted into the pocket. Insert one hand inside the pocket and grab from one corner all of the fabric you can from the pile that is folded on the outside below. Pull the folded fabric from outside in. When it is inside, the bag is now completely stuffed and in the pillow position—also ready to either use as a backpack, shoulder bag/carrier and rolling on wheels backpack/sleeping bag. Smooth it out so that there is no bulge. During this process the pillow, which is attached with Velcro®, can either be folded in place where it belongs with the Velcro® fasteners, or it can be detached and inserted into the one of additional two pockets.

The same concept is utilized having thinner exterior fabric covers which again has two sides which are sewn along the edges and sewn along a bottom edge. Sewn within the interior closed edge is a towel. The towel is then rolled up or folded up and is housed within the container and the container can contain straps to be worn as a backpack or other straps to be worn as a shoulder bag. When in use the container is placed on the ground and the outer covering is opened inside out to expose the towel which can then be unfolded and used as a towel.

A similar concept is used for a comforter which has a thicker pair of front and rear surfaces which again are attached or sewn together along the edges and also sewn along one end portion leaving again one opening. A comforter is sewn within the interior of the cover adjacent the closed end. It is rolled up or folded up to be housed within the cover which in turn can be carried by shoulder straps or side straps to be carried as a backpack. When in use, once again the device is laid on the ground and is folded inside out so that the comforter is exposed and then can be unrolled or unfolded to form a sleeping arrangement.

Defined in detail, the present invention is a sleeping bag which converts into a backpack, comprising: (a) a fabric container having an exterior surface supporting at least one pocket having opening means to permit objects to be retained within the pocket, the fabric container having a bottom end to which are attached a pair of rollers, and two sides having lengthwise edges, the fabric container sewn together along the lengthwise edges and along the bottom end and being open along its edge opposite the bottom; (b) a bedspread comprising a top portion and a bottom portion each having a bottom end, a pair of lengthwise edges and a top end, the bottom ends of the bedspread sewn into the interior of the fabric container adjacent the closed bottom end of the fabric container, the top and bottom portions of the bedspread sewn together along one pair of lengthwise edges and attached together by fastening means along the opposite pair of lengthwise edges so that an occupant can separate the top and bottom portions to enter the bedspread; (c) the bedspread capable of being folded along its lengthwise edges so that its width fits within the fabric container so that the length of the bedspread is folded into a multiplicity of sections and thereafter placed within the fabric container; (d) the bottom portion of the bedspread further comprising an opening adjacent its top end to facilitate the insertion of a pillow therein; and (e) an elongated strap member movably and slidably affixed to the exterior surface of the fabric container so that the strap member is positioned as a pair of straps adjacent opposite sides of the fabric container so that the fabric container may be worn as a backpack over a person's shoulders, or alternatively, the strap can be formed as one long strap so that the fabric container may be worn as a shoulder bag with the strap resting over one of the person's shoulders, or alternatively, the strap can be used as a pull strap to permit the fabric container to be rolled along the ground on its pair of rollers; (f) whereby, when in use as a sleeping bag, the fabric container is placed on the ground and folded inside out and the bedspread is extended out of the container while still being attached thereto at its bottom end and is unfolded so that the bedspread is unrolled and spread along the ground and laid flat on the ground and opened along one lengthwise edge so that the person can enter the bedspread and thereafter close the lengthwise edge with the person's head resting adjacent the top end of the bedspread and when in use as a backpack, the bedspread is once again folded along its lengthwise edges so that its width fits within the fabric container and the fabric container is folded back outside to receive the bedspread which is folded into a multiplicity of folds along its length to be inserted into the fabric container, which is then transported as a backpack or a shoulder bag or rolled along the ground on its rollers.

Defined more broadly, the present invention is a sleeping bag which converts into a backpack, comprising: (a) a container having an exterior surface, a bottom end and two sides having lengthwise edges, the container closed along its bottom end and along its two sides and open along its edge opposite the closed bottom; (b) a bedspread comprising a top portion and a bottom portion each having a bottom end and a pair of lengthwise edges and a top end, the bottom ends affixed to the interior of the container adjacent its closed bottom, the top and bottom portions of the bedspread affixed to each other along their lengthwise edges with at least one pair of lengthwise edges removably affixed by fastening means along the at least one pair of lengthwise edges so that an occupant can separate the edges to enter the bedspread; (c) the bedspread capable of being folded along its lengthwise edges so that its width fits within the container so that the length of the bedspread is folded into a multiplicity of sections and thereafter placed within the fabric container; and (d) an elongated strap member movably and slidably affixed to the exterior surface of the container so that the strap member is positioned as a pair of straps adjacent opposite sides of the fabric container so that the container may be worn as a backpack over a person's shoulders, or alternatively, the strap can be formed as one long strap so that the container may be worn as a shoulder bag; (e) whereby, when in use as a sleeping bag, the container is placed on the ground and folded inside out and the bedspread is extended out of the container while still being attached thereto at its bottom end and is unfolded so that the bedspread is unrolled and spread along the ground and laid flat on the ground and opened along one lengthwise edge so that a person can enter the bedspread and thereafter closed along the lengthwise edge with the person's head resting adjacent the top end of the bedspread and when in use as a backpack, the bedspread is once again folded along its lengthwise edges so that its width fits within the container and the container is folded back outside to receive the bedspread which is folded into a multiplicity of folds along its length to be inserted into the fabric container, which is then transported by means of its elongated strap.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A sleeping bag which converts into a backpack, comprising:

a. a fabric container having an exterior surface supporting at least one pocket having opening means to permit objects to be retained within the pocket, the fabric container having a bottom end to which are attached a pair of rollers, and two sides having lengthwise edges, the fabric container sewn together along the lengthwise edges and along the bottom end and being open along its edge opposite the bottom;

b. a bedspread comprising a top portion and a bottom portion each having a bottom end, a pair of lengthwise edges and a top end, the bottom ends of the bedspread sewn into the interior of the fabric container adjacent the closed bottom end of the fabric container, the top and bottom portions of the bedspread sewn together along one pair of lengthwise edges and attached together by fastening means along the opposite pair of lengthwise edges so that an occupant can separate the top and bottom portions to enter the bedspread;

c. the bedspread capable of being folded along its lengthwise edges so that its width fits within the fabric container so that the length of the bedspread is folded into a multiplicity of sections and thereafter placed within the fabric container;

d. the bottom portion of the bedspread further comprising an opening adjacent its top end to facilitate the insertion of a pillow therein; and e. an elongated strap member movably and slidably affixed to the exterior surface of the fabric container so that the strap member is positioned as a pair of straps adjacent opposite sides of the fabric container so that the fabric container may be worn as a backpack over a person's shoulders, or alternatively, the strap can be formed as one long strap so that the fabric container may be worn as a shoulder bag with the strap resting over one of the person's shoulders, or alternatively, the strap can be used as a pull strap to permit the fabric container to be rolled along the ground on its pair of rollers;

f. whereby, when in use as a sleeping bag, the fabric container is placed on the ground and folded inside out and the bedspread is extended out of the container while still being attached thereto at its bottom end and is unfolded so that the bedspread is unrolled and spread along the ground and laid flat on the ground and opened along one lengthwise edge so that the person can enter the bedspread and thereafter close the lengthwise edge with the person's head resting adjacent the top end of the bedspread and when in use as a backpack, the bedspread is once again folded along its lengthwise edges so that its width fits within the fabric container and the fabric container is folded back outside to receive the bedspread which is folded into a multiplicity of folds along its length to be inserted into the fabric container, which is then transported as a backpack or a shoulder bag or rolled along the ground on its rollers.

2. The invention in accordance with claim 1, wherein said pair or rollers are permanently affixed to the fabric container.

3. The invention in accordance with claim 1, wherein said pair of rollers are removably affixed to the fabric container.

4. The invention in accordance with claim 1, wherein the fastening means by which the pair of lengthwise edges of the bedspread are closed are mating hook and loop fasteners.

5. The invention in accordance with claim 1, wherein the fastening means by which the pair of lengthwise edges of the bedspread are closed is a zipper.

6. The invention in accordance with claim 1, wherein the top portion and bottom portion of the bedspread each further comprise batting fabric material within them.

7. The invention in accordance with claim 1, further comprising a pillow which is removably affixed by fastening means to a top surface of the bottom portion of the bedspread adjacent its top end.

8. The invention in accordance with claim 1, further comprising a multiplicity of pockets affixed to said fabric container so that the pockets can retain any multiplicity of objects such as a pillow and toiletries.

9. The invention in accordance with claim 8, wherein at least one of the pockets is designed into the shape of a pattern which matches the shape of a design on the bedspread.

* * * * *